US007543776B2

(12) United States Patent
Kurzyniec

(10) Patent No.: US 7,543,776 B2
(45) Date of Patent: Jun. 9, 2009

(54) VERTICAL CABLE REEL CARRIER

(76) Inventor: Peter Kurzyniec, 45379 Indian Creek Dr., Canton, MI (US) 48187

( * ) Notice: Subject to any disclaimer, the term of this patent is extended or adjusted under 35 U.S.C. 154(b) by 416 days.

(21) Appl. No.: 11/164,874

(22) Filed: Dec. 8, 2005

(65) Prior Publication Data

US 2006/0196988 A1 Sep. 7, 2006

Related U.S. Application Data

(60) Provisional application No. 60/634,208, filed on Dec. 8, 2004.

(51) Int. Cl.
*B65H 16/04* (2006.01)

(52) U.S. Cl. ..... 242/597.7; 242/423

(58) Field of Classification Search ..... 242/597.7, 242/405, 405.3, 588, 588.2, 588.3, 588.6, 242/423, 597.6, 599.3, 599.4, 557
See application file for complete search history.

(56) References Cited

U.S. PATENT DOCUMENTS

| | | | | | |
|---|---|---|---|---|---|
| 4,238,086 | A | * | 12/1980 | Brimmeier | 242/396.7 |
| 4,284,180 | A | * | 8/1981 | Masters | 191/12.2 R |
| 5,462,298 | A | | 10/1995 | Bodine | |
| 5,615,844 | A | * | 4/1997 | Bosch | 242/395 |
| 5,732,611 | A | | 3/1998 | Voyer et al. | |
| 5,900,586 | A | | 5/1999 | Carr | |
| 5,957,400 | A | | 9/1999 | Brennen | |
| 6,056,226 | A | * | 5/2000 | Green | 242/395 |
| 6,349,534 | B1 | | 2/2002 | Zanolla et al. | |

* cited by examiner

*Primary Examiner*—William A Rivera
(74) *Attorney, Agent, or Firm*—Dickinson Wright PLLC

(57) ABSTRACT

A reel carrier system for vertical transportation of a reel includes a base having an inner portion rotatable with respect to an outer portion. The inner portion is attached to a perpendicular post such that rotation of the post rotates the inner portion. Coupled to the post is a handle such that rotation of the handle rotates the post. At least one of the handle and the attachment section detaches from the post for disposing the reel on the inner portion.

17 Claims, 3 Drawing Sheets

VERTICAL CABLE REEL CARRIER

CROSS-REFERENCE TO RELATED APPLICATIONS

This case is related to the subject matter as set forth in Provisional Patent Application Ser. No. 60/634,208 filed Dec. 8, 2004 and titled "Vertical Oriented Cable Reel Carrier."

TECHNICAL FIELD

The present invention relates generally to cable reels, and, more particularly, to a device for carrying and dispensing a reel of cable.

BACKGROUND OF THE INVENTION

With the ever-increasing demand for cable service (analog, digital, digital video recorder, high definition T.V., voice over internet provider (VOIP), and high speed and broadband internet services); the demand for technicians and installers of cable continues to grow. Currently, cables are wound on reels in a coiled configuration. To remove a length of cable from a reel, an installer typically mounts the reel on some type of holder such that it can rotate, and then proceeds to pull the cable from one end. Because the reel is often rotatably mounted, as the installer pulls on the end of the wire or cable, the reel rotates causing the cable to unwind from the reel in a relatively straight (i.e. non-spiraled) configuration.

A problem associated with current systems is that it is often difficult or inefficient to transport the cable as the installers must bend down to pick up a reel, carry it to its desired installation location, and again bend down to deposit the reel on a floor. It is desirable to limit the bending of the cable installers and thereby limiting potential back injuries resulting from lifting the cable.

It is therefore desirable to provide a carrier for cable that may be easily transported from one location, e.g. a truck, to a place of installation while requiring a minimum amount of bending over on the part of an installer. It would further be desirable for an installer to carry larger reels or spools of cable and thereby increase the efficiency of installation of the cable. It would also be desirable for an installer to be able to accommodate more than one spool or reel (e.g. a cable wire reel and a ground wire reel).

SUMMARY OF THE INVENTION

It is accordingly an object of the present invention to provide a cable carrier that facilitates loading and unloading of cable from a vehicle. It is also an object of the present invention to provide an ergonomically correct cable-carrying device such that bending over by a cable installer or cable carrier is limited and maneuvering of cables in tight spaces is simplified. It is a further object of the present invention to limit damage to walls, floors, and entry door glass created by current reel carrying systems. Further objects of the present invention include minimizing the amount of space occupied by cable reels and ultimately increasing a cable installer's or a technician's productivity.

In accordance with one embodiment of the present invention, a reel carrier system for vertical transportation of a reel includes a base having an inner portion rotatable with respect to an outer portion. The inner portion is attached to a perpendicular post such that rotation of the post rotates the inner portion. Coupled to the post is a handle such that rotation of the handle rotates the post. At least one of the handle or the attachment section detaches from the post for disposing the reel on the inner portion.

Additional advantages and features of the present invention will become apparent under the description that follows and may be realized by means of the instrumentalities and combinations, particularly pointed out in the pending claims, taken in conjunction with the accompanying drawings.

BRIEF DESCRIPTION OF THE DRAWINGS

In order that the invention may be well understood, they will now be described some embodiments thereof, given by way of example, referencing made to the accompanying drawings in which.

DETAILED DESCRIPTION

While the present invention is described primarily with respect to a vertical cable reel carrier, the present invention may be adapted to various application requiring carrying of wound materials, as will be understood by the one skilled in the art.

In the following description, various operating parameters and components are described for a number of constructed embodiments. These specific parameters and components are included as examples and are not meant to be limiting.

Figure 1:
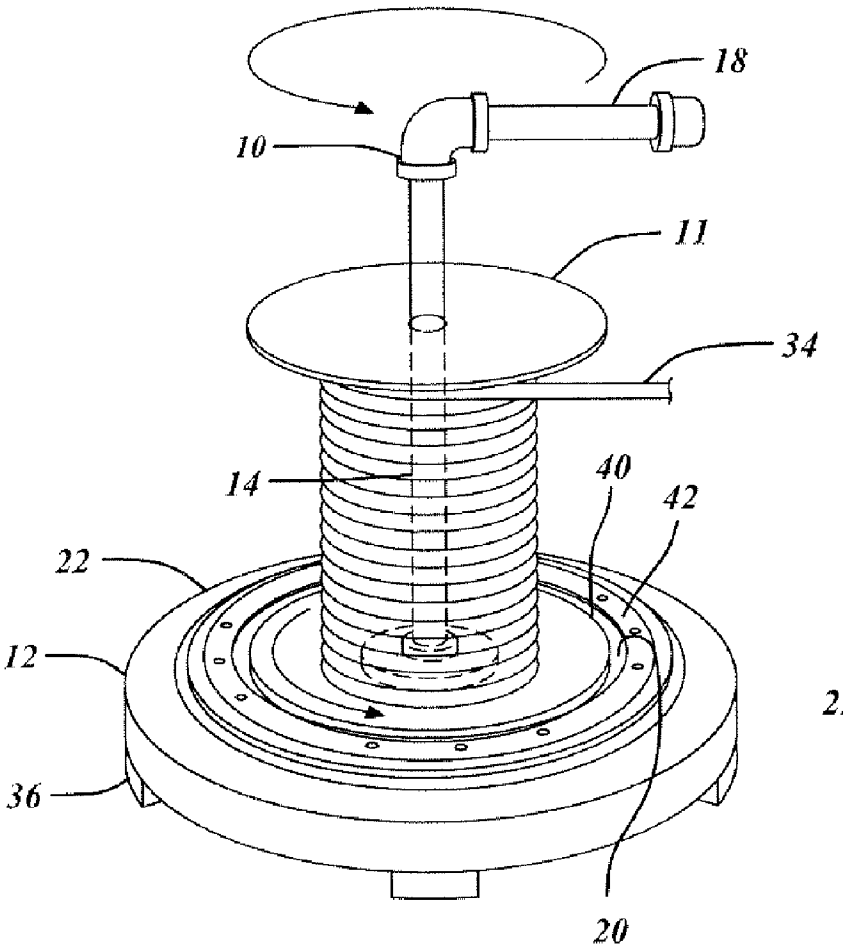
FIG. 1 is a perspective view of a cable reel carrier system in accordance with one embodiment of the present invention.

Referring to FIG. 1, a vertical cable reel carrier system 8 including a vertical cable reel carrier 10 carrying a cable reel 11 is illustrated in accordance with one embodiment of the present invention. The reel carrier 10 includes a base 12 and a post 14 extending generally upwardly therefrom onto which the spool or reel 16 is installed. Attached to the posts 14 is a handle 18 for turning the spool or reel 16.

Figure 3:
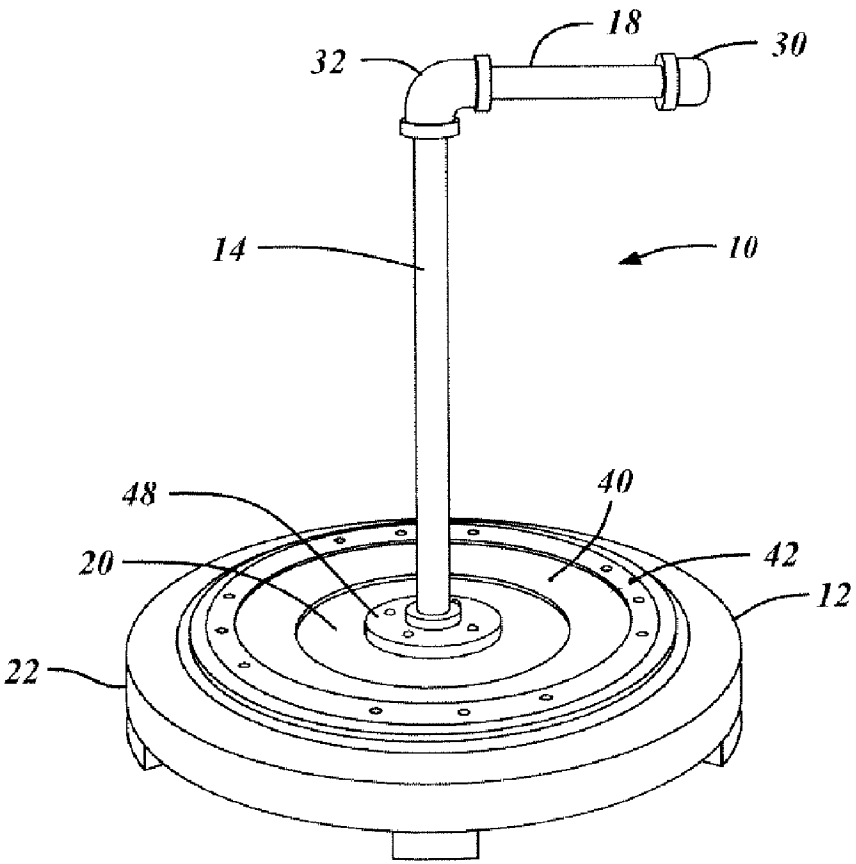
FIG. 3 is a perspective view of a carrier for the cable reel carrier system in accordance with another embodiment of the present invention.
Figure 2:
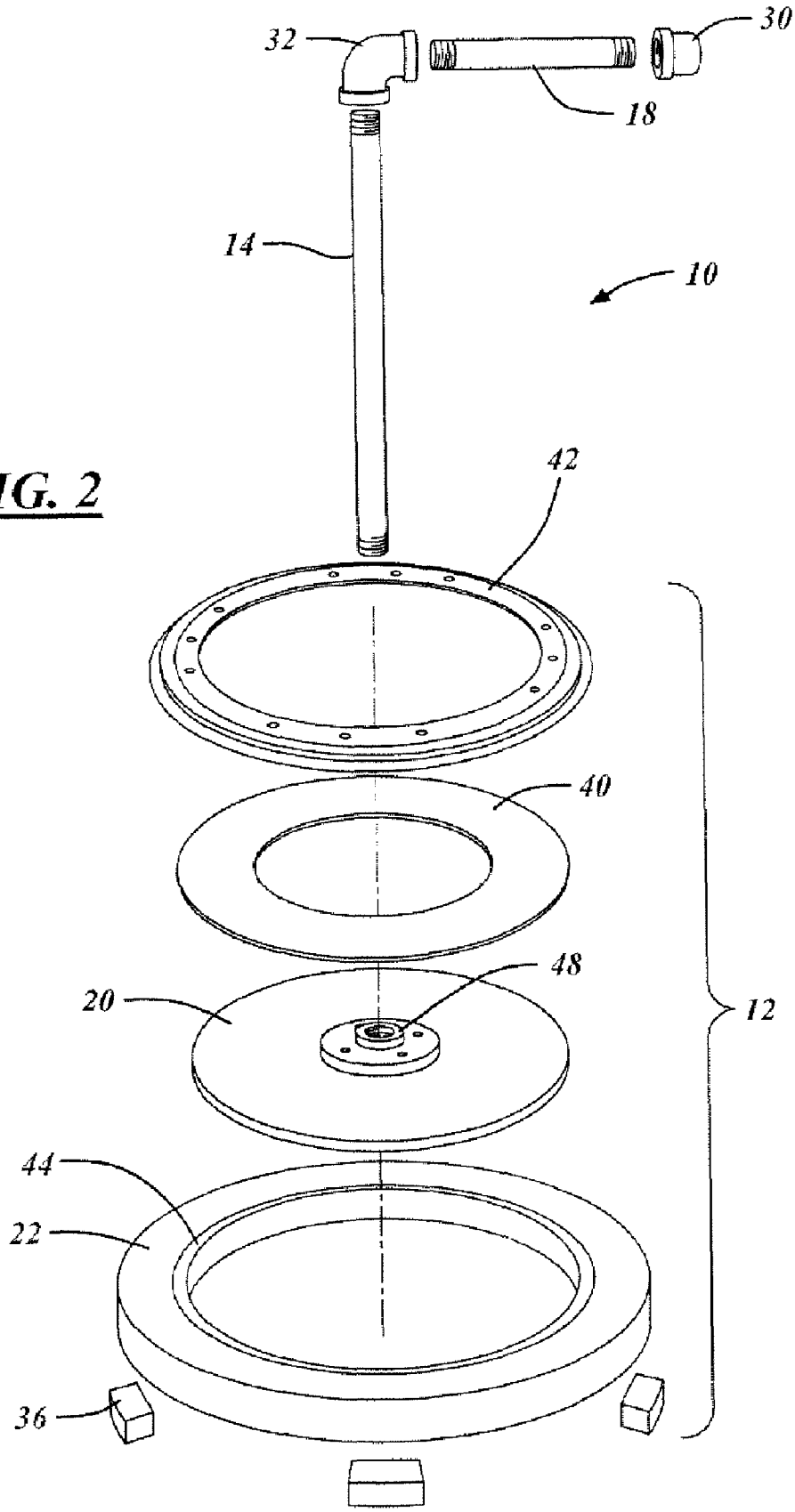
FIG. 2 is an exploded view of a carrier for the cable reel carrier system of FIG. 1.

Referring to FIGS. 1-3, the system 8 is further illustrated. As mentioned, the system 8 includes a handle 18 attached to the post 14. The handle 18 is embodied as coupled at a 90° angle relative to the post 14, however various other angles may be used in accordance with the present invention. Further, the handle 18 is embodied as being a straight single piece of pipe, however, once skilled in the art will realize that various other handle designs are also included in the present invention, including such ergonomically correct grips as a loop handle, a chain handle, a hook handle, or an orthopedic grip handle. The handle 18 includes a cap 30 at a first end thereof and an elbowjoint 32 at a second end thereof, whereby the elbow joint 32 couples to the post 14. The post 14 couples to the base 12, and more specifically, to the pipe base attachment section 48 on an inner portion 20 of the base 12.

The base 12 includes an inner portion 20 and an outer portion 22 that can rotate with respect to one another. This provides a turntable or lazy Susan effect and allows the base 12 and the post 14 to rotate, which in turns allows the attached spool 11 to rotate such that the cable 34 can be rotated and unwound for use. The reel 16 rests on the base 12 in a vertical orientation such that it can be unwound and transported in the same vertical orientation. The base 12 also includes a plurality of feet or stabilizers 36 such that the outer portion 22 may be prevented from contacting the floor directly. Important to note is that there is alternate embodiments of support structure for the outer portion 22 may be included in accordance with alternate embodiments of the present invention, such as a single rim or other combinations or designs of feet or no feet. The base 12 may also include a cover portion 40 positioned between the inner portion 20 and the outer portion 22 for providing smooth rotation of the portions 20, 22. The outer portion 22 includes an upper rim 42 for holding the inner portion 22 in place and allowing the system 10 to be lifted without detaching the inner portion 20 from the outer portion 22. The outer portion 22 also includes a lower rim 44, which may include ball bearings, which may be sealed for keeping out water or debris, or a track for rotating the inner portion 20. The base 12 may include a composite or fiber material for robustness of the base 12 in all weather conditions.

The inner portion 20 is embodied as partially visible when the system 10 is fully assembled, as illustrated in FIG. 1. However, the inner portion 20 may be minimally visible as the upper rim 42 or the section 40 may conceal an increased amount of the inner portion 20. The inner portion 20 is embodied including an attachment section 48 for attaching the post 14. The attachment section 48 is embodied as a pipe attachment section but may be alternately embodied as any type of locking mechanism for holding a pipe or other handle component fixedly attached thereto and may include a quick release mechanism such as a track or set of mating connectors coupled to the post 14 and the attachment section 48.

The post 14 may be detachable to either the elbow 32 or the attachment section 48 such that the reel 11 may be removed, another reel may be put in its place, and the system 10 reassembled. The elbow 32 or the attachment section 48 may include any sort of attachment, detachment or coupling device known in the art, such as including threaded ends or a locking mechanism.

Figures 4, 5, 6:
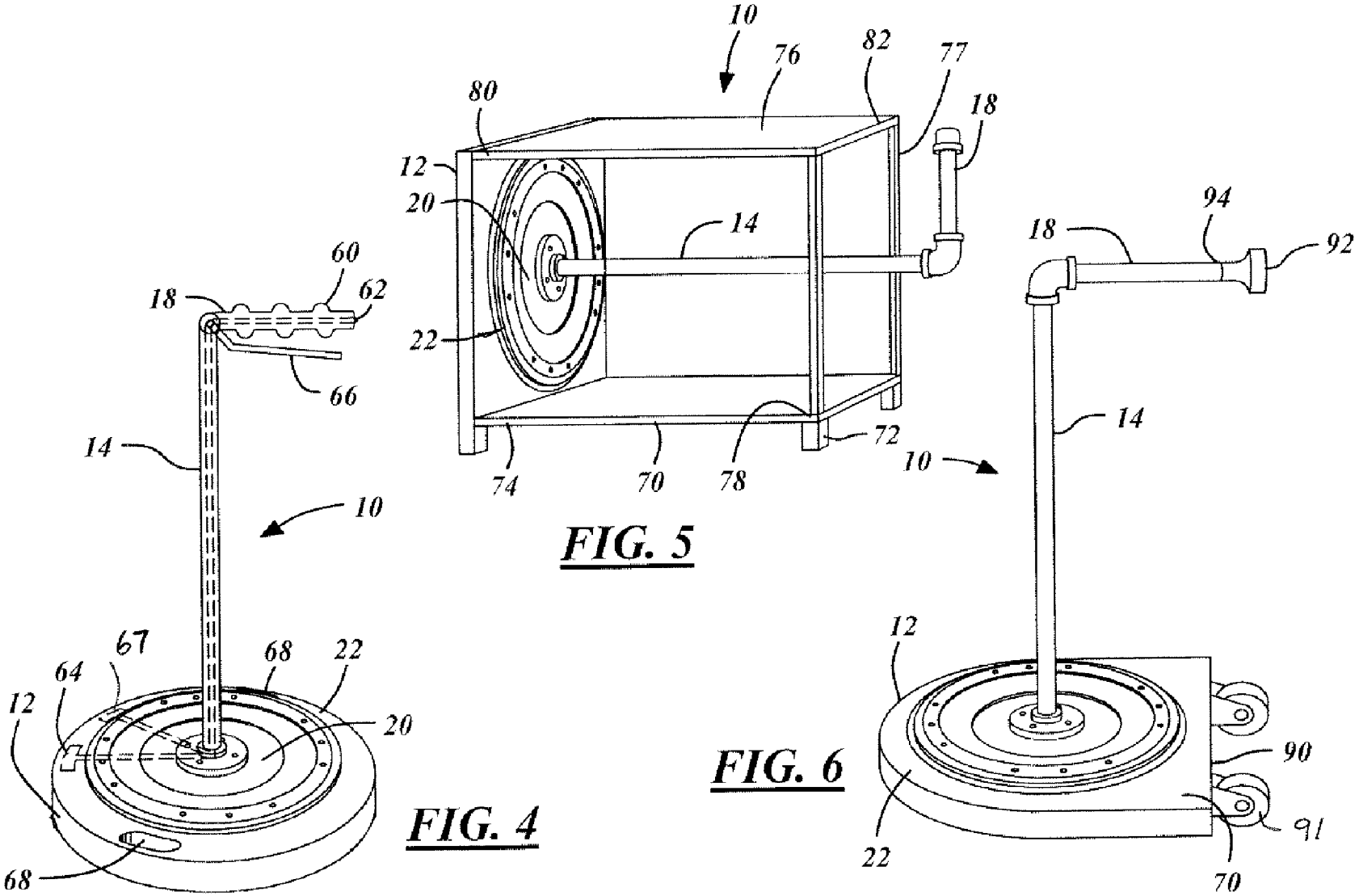
FIG. 4 is a perspective view of a carrier for the cable reel carrier system in accordance with another embodiment of the present invention.
FIG. 5 is a perspective view of a carrier for the cable reel carrier system in accordance with another embodiment of the present invention.
FIG. 6 is a perspective view of a carrier for the cable reel carrier system in accordance with another embodiment of the present invention.

Referring to FIGS. 4-6, alternate embodiments of the present invention are illustrated. In FIG. 4, the handle 18 is embodied with an orthopedic (ergonomically correct) grip 60. The handle 18 also includes a lock 62, illustrated as a button that, when depressed, engages locking portions 64 (illustrated in phantom lines) for preventing rotation of the inner portion 20 of the base 12. The lock 62 may be a push-push mechanism or other known mechanism for engaging and disengaging locking portions 64. The handle 18 is also adjacent or coupled to a clutch-brake 66 (activating a brake portion 67) for limiting or halting rotation of the inner portion 20 of the base 12. Important to note is that a stopping mechanism may be included for the present invention for limiting movement of the inner portion 20 and this mechanisms may be embodied as the lock 62 or the clutch-brake 66. The base 12 of FIG. 4 includes slots 68 such that the base 12 may be lifted and carried through the installer grabbing onto the base 12 at the slots 68.

In FIG. 5, the cable reel carrier 10 is embodied including a side mount 70, which may include legs 72 (portion of side mount 70), such that the reel carrier 10 may be positioned horizontally and said legs may act as a support. The side mount 70 is embodied as coupled to the outer potion 22 of the base 12 at a first end 74 and to a step 76 through support structures 77 at a second end 78. The step 76 is included for support of the side mount 70 and for use by an installer as a load-bearing step. Alternate embodiments include the step 76 detachably coupled to the base 12 at a first end 80 and having legs at a second end 82 for support. Important to note is that the handle 18 may be elongated for this embodiment such that the post 14 may be turned while the step 76 is attached to the base 12.

In FIG. 6, the cable reel carrier 10 is embodied including a side mount 70 surrounding the outer portion 22 of the base 12 and having a flat edge 90, which may have wheels 91 coupled thereto (the flat edge or the wheels may also be a portion of side mount 70 for the purposes of this invention) and an elongated handle 18 having a support 92 or stopper (e.g. rubber stopper) attached to an end 94 thereof. This configuration also allows that reel carrier 10 may be positioned horizontally whereby the edge 90 or the wheels 91 may be used as supports. The support 92 is generally flat such that it is stable when used as a leg for a reel carrier 10. Therefore, the flat edge 90 and the handle 18 act as legs when the reel carrier is horizontal. In accordance with this embodiment, a step may be coupled to the base 12 as in FIG. 5 or, alternately, the post 14 may be used as a step.

While the invention has been described in connection with one or more embodiments, it is to be understood that the specific mechanisms and techniques, which have been described are merely illustrative of the examples of the invention. Numerous modifications may be made to the methods and apparatus described without departing from the spirit and scope of the invention as defined by the pending claims.

What is claimed is:

1. A reel carrier system for vertical transportation of a reel comprising: a base comprising an inner portion and an outer portion, such that said inner portion rotates with respect to said outer portion, said inner portion comprising an attachment section; a post coupled to said attachment section such that rotation of said post rotates said inner portion, said post substantially vertical when said base is horizontal; a handle coupled to said post such that rotation of said handle rotates said post, whereby at least one of said handle and said attachment section detaches from said post for disposing the reel on said inner portion; and a clutch brake coupled to at least one of said handle and said post for limiting movement of said inner portion.

2. The system of claim 1 further comprising at least one of ball bearings and a track such that said inner portion rotates with respect to said outer portion as a function of operation of said at least one of said ball bearings and said track.

3. The system of claim 1, wherein said base defines slots therein for lifting said base.

4. The system of claim 1, wherein said handle comprises an ergonomically correct grip.

5. The system of claim 1 further comprising a side mount coupled to said base.

6. The system of claim 5, wherein said side mount further comprises legs such tat the system is horizontally positionable.

7. The system of claim 5, wherein said side mount is coupled to a support structure for stabilizing said side mount.

8. The system of claim 1, wherein said outer portion further comprises an upper rim such that said upper rim holds said inner portion within said outer portion when the system is lifted at said handle.

9. The system of claim 1 further comprising a cover portion positioned between said inner portion and said outer portion for providing smooth rotation of said inner portion and said outer portion.

10. A reel carrier system for vertical transportation of a reel comprising: a base comprising an inner portion and an outer portion, such that said inner portion rotates with respect to said outer portion, said inner portion comprising an attachment section; a post coupled to said attachment section such that rotation of said post rotates said inner portion, said post substantially vertical when said base is horizontal; a handle coupled to said post such that rotation of said handle rotates said post, whereby at least one of said handle and said attachment section detaches from said post for disposing the reel on said inner portion; and a lock locking said inner portion with respect to said outer portion.

11. A reel carrier system for vertical transportation of a reel comprising: a base comprising an inner portion and an outer portion, such that said inner portion rotates with respect to said outer portion, said inner portion comprising an attachment section; a post coupled to said attachment section such that rotation of said post rotates said inner portion, said post substantially vertical when said base is horizontal; a handle coupled to said post such that rotation of said handle rotates said post, whereby at least one of said handle and said attachment section detaches from said post for disposing the reel on said inner portion; and a step coupled to said base such that the system is usable as a stool.

12. The system of claim 11 further comprising a side mount comprising a first end and a second end, wherein said first end is coupled to said base and said second is coupled to said step through support structures.

13. A reel carrier system for vertical transportation of a reel comprising: a base comprising art inner portion and an outer portion, such that said inner portion rotates with respect to said outer portion, said inner portion comprising an attachment section; a post coupled to said attachment section such that rotation of said post rotates said inner portion, said post substantially vertical when said base is horizontal; a handle coupled to said post such that rotation of said handle rotates said post, whereby at least one of said handle and said attachment section detaches from said post for disposing the reel on said inner portion; and a detachable step coupled to said base such that said step is at least one of vertically oriented with respect to said base and horizontally oriented with respect to said base.

14. A reel carrier system for transportation of a reel comprising: a base comprising an inner portion and an outer portion, such that said inner portion rotates with respect to said outer portion, said outer portion further comprising an upper rim such that said upper rim holds said inner portion within said outer portion, said inner portion comprising an attachment section; a post coupled to said attachment section such that rotation of said post rotates said attachment section, said post substantially perpendicular to said base; a handle coupled perpendicular to said post such that rotation of said handle rotates said post, whereby at least one of said handle and said attachment section detaches from said post for disposing the reel on said inner portion; and a stopping mechanism for limiting turning of said inner portion.

15. The system of claim 14, wherein said stopping mechanism comprises at least one of a clutch-brake and a lock.

16. The system of claim 14 further comprising a side mount coupled to said base such that said side mount is oriented at least one of: planar with said base and perpendicular to said base.

17. The system of claim 14 further comprising a step such that said step is at least one of vertically oriented with respect to said base and horizontally oriented with respect to said base.

* * * * *

UNITED STATES PATENT AND TRADEMARK OFFICE

CERTIFICATE OF CORRECTION

PATENT NO. : 7,543,776 B2
APPLICATION NO. : 11/164874
DATED : June 9, 2009
INVENTOR(S) : Peter Kurzyniec It is certified that error appears in the above-identified patent and that said Letters Patent is hereby corrected as shown below:

Column 2, line 62: “elbowjoint” should read --elbow joint--.

Column 4, Claim 6, line 56: “tat” should read --that--.

Column 5, Claim 13, line 30: “art” should read --an--.

Signed and Sealed this

Fourth Day of August, 2009

JOHN DOLL
*Acting Director of the United States Patent and Trademark Office*